US009677831B2

(12) United States Patent
Martin et al.

(10) Patent No.: US 9,677,831 B2
(45) Date of Patent: Jun. 13, 2017

(54) DEVICE WITH A HEAT EXCHANGER AND METHOD FOR OPERATING A HEAT EXCHANGER OF A STEAM GENERATING PLANT

(75) Inventors: Johannes Martin, Munich (DE); Robert von Raven, Seeshaupt (DE); Alexander Seitz, Weilheim (DE)

(73) Assignee: Martin GmbH fuer Umwelt—und Energietechnik, Munich (DE)

( * ) Notice: Subject to any disclaimer, the term of this patent is extended or adjusted under 35 U.S.C. 154(b) by 507 days.

(21) Appl. No.: 13/136,942

(22) Filed: Aug. 15, 2011

(65) Prior Publication Data

US 2012/0085517 A1 Apr. 12, 2012

Related U.S. Application Data

(60) Provisional application No. 61/404,963, filed on Oct. 13, 2010.

(30) Foreign Application Priority Data

Oct. 12, 2010 (DE) ..... 10 2010 048 065

(51) Int. Cl.

| | |
|---|---|
| ***F22B 37/26*** | (2006.01) |
| ***F28F 27/02*** | (2006.01) |
| ***G05D 23/00*** | (2006.01) |
| ***F22B 1/18*** | (2006.01) |
| ***F22B 15/00*** | (2006.01) |

(Continued)

(52) U.S. Cl.

CPC ..... *F28F 27/02* (2013.01); *F22B 1/18* (2013.01); *F22B 15/00* (2013.01); *F22B 31/00* (2013.01); *F22B 31/08* (2013.01); *F22D 1/02* (2013.01); *F22G 1/02* (2013.01)

(58) Field of Classification Search

CPC ..... F22B 35/007; F01K 23/10; F01K 23/101; F01K 23/106; F01K 23/108; F28F 2250/00; F28F 2250/06; F28F 2250/10; F28F 2250/104

USPC ..... 165/97, 100, 103, 297, 300, 110, 298, 165/299; 60/39.182, 39.3; 122/7 R, 470, (Continued)

(56) References Cited

U.S. PATENT DOCUMENTS 3,942,482 A * 3/1976 Barratt et al. ..... 122/32
4,102,393 A * 7/1978 Withers, Jr. ..... 165/95

(Continued)

FOREIGN PATENT DOCUMENTS

| | | |
|---|---|---|
| AT | 219 629 | 2/1962 |
| DE | 445 460 | 6/1927 |

(Continued)

OTHER PUBLICATIONS

Jekerle, Jiri, et al., WIPO Publication No. 2010/034292, Apr. 1, 2010.*

*Primary Examiner* — Ryan J Walters
*Assistant Examiner* — Jason Thompson
(74) *Attorney, Agent, or Firm* — Collard & Roe, P.C.

(57) ABSTRACT

A device with a heat exchanger with a feed pipe for a medium leading from a medium inlet to the heat exchanger entrance and with a discharge pipe leading away from the heat exchanger exit is characterized in that it has a first bypass from the medium inlet to the discharge pipe and a second bypass from the feed pipe to the medium outlet and valves, so that the medium can also flow from the heat exchanger exit to the heat exchanger entrance.

4 Claims, 3 Drawing Sheets

(51) Int. Cl.

| | |
|---|---|
| ***F22B 31/00*** | (2006.01) |
| ***F22B 31/08*** | (2006.01) |
| ***F22D 1/02*** | (2006.01) |
| ***F22G 1/02*** | (2006.01) |

(58) Field of Classification Search
USPC ..... 122/477, 1 C, 33, 406.5; 110/185, 110/203–217; 62/272
See application file for complete search history.

(56) References Cited

U.S. PATENT DOCUMENTS

| | | | | | |
|---|---|---|---|---|---|
| 4,224,802 | A | | 9/1980 | Ooka | |
| 4,304,259 | A | * | 12/1981 | Brunner | F22B 1/1807 137/599.08 |
| 5,145,652 | A | * | 9/1992 | Veser et al. | 422/171 |
| 5,159,975 | A | * | 11/1992 | Murphy | 165/110 |
| 6,427,636 | B1 | * | 8/2002 | Liebig | 122/1 R |
| 2006/0169305 | A1 | * | 8/2006 | Jansen | B08B 9/00 134/22.18 |
| 2010/0199631 | A1 | * | 8/2010 | Vilimec et al. | 60/39.182 |
| 2011/0186275 | A1 | * | 8/2011 | Jekerle et al. | 165/172 |

FOREIGN PATENT DOCUMENTS

| | | | | |
|---|---|---|---|---|
| DE | 219 629 | | 2/1962 | |
| DE | 29 12 321 | | 10/1979 | |
| DE | 10 2005 017 974 | | 11/2006 | |
| DE | 10 2008 048 405 | | 4/2010 | |
| DE | WO 2010/034292 | * | 4/2010 | F28F 27/02 |
| JP | 2000304231 A | | 11/2000 | |

* cited by examiner

DEVICE WITH A HEAT EXCHANGER AND METHOD FOR OPERATING A HEAT EXCHANGER OF A STEAM GENERATING PLANT

CROSS REFERENCE TO RELATED APPLICATIONS

Applicants claim priority under 35 U.S.C. §119 of German Application No. 10 2010 048 065.7 filed on Oct. 12, 2010 and under 35 U.S.C. §119(e) of U.S. Provisional Patent Application Ser. No. 61/404,963 filed on Oct. 13, 2010, the disclosures of which are incorporated herein by reference.

BACKGROUND OF THE INVENTION

1. Field of the Invention

The invention relates to a device with a heat exchanger with a feed pipe for a medium leading from a medium inlet to the heat exchanger entrance and with a discharge pipe leading away from the heat exchanger exit.

2. The Prior Art

Such type heat exchangers are needed in many applications. The transferred energy is thereby determined by the different temperatures of the media that are carried in the heat exchanger. Different control mechanisms are known for varying the volume flow of these media. Since it is frequently necessary to achieve certain medium temperatures without it being possible, as a rule, to modify the surface of the heat exchanger, the flow speed in the heat exchanger is varied.

An alternative to this can be to operate the heat exchanger in a concurrent or a countercurrent flow. While the medium temperatures at the heat exchanger exit can converge strongly in the concurrent flow operating mode, the countercurrent flow operating mode provides, as a rule, a higher heat exchange with the same heat exchanger surface. Using the switch from concurrent flow to countercurrent flow as a control mechanism must be rejected, since the piping is already determined during installation of the heat exchanger and cannot be changed during operation.

A specific field of application of particularly big heat exchangers is the heating and cooling of gases of firing systems which are used as steam generating plants. In such plants, the air supplied to the fire grate, respectively to the combustion area, must be preheated and the exhaust gases are cooled. Heat exchangers are thereby used as evaporators and superheaters, in order to supply a turbine with steam. The feed water of the steam generator is frequently preheated in an economizer to further cool the exhaust gases.

During the operating time of the steam generating plant, the exhaust gas temperature varies in accordance with the combustion process. Furthermore, deposits occur in the evaporator and in the superheaters, thus compromising the effectiveness of the heat exchangers. The economizer is thereby eventually exposed to different exhaust gas temperatures. The effectiveness of the economizer furthermore also varies according to the deposits produced by the exhaust gases in the pipes of the heat exchanger.

Most of the time, a denitrogenization plant, the catalytic effects of which only take place in an optimal manner at certain temperatures, is provided downstream of the economizer. In SCR plants for instance, these temperatures lie between 250° C. and 270° C.

During the first operating hours of such a plant, the heat exchangers still have a high effectiveness which however decreases during the operating time due to deposits. The run time of the plant is more specifically also determined by the fact that the exhaust gas temperature at the denitrogenization plant must remain inside a determined temperature window.

SUMMARY OF THE INVENTION

The object underlying the invention is therefore to further develop a generic device in such a manner that the desired temperature windows can be maintained for a longer period of time.

In a generic device, this object is solved by the device having a first bypass from the medium inlet to the discharge pipe and a second bypass from the feed pipe to the medium outlet as well as valves, so that the medium can also flow from the heat exchanger exit to the heat exchanger entrance.

Providing permanent bypasses in the specified places makes it possible to operate the heat exchanger in concurrent and in countercurrent flow simply by retrofitting it with two pipes and corresponding valves.

In the example of an economizer of a steam generating plant, this means that the economizer can be operated for instance at the beginning in concurrent flow. When the effectiveness of the heat exchanger decreases because of the deposits, the temperature of the exhaust gases increases. By switching the heat exchanger from concurrent flow to countercurrent flow, the exhaust gas temperature is lowered. The heat exchanger can thus continue to operate, since the exhaust gas temperature further remains in the specified temperature window. In the example of an economizer connected upstream of an SCR plant, the exhaust gas temperature can be lowered from 265 degrees Celsius to 255 degrees Celsius simply by switching from concurrent flow to countercurrent flow. The run time of the plant can thus be considerably extended.

It is possible to provide valves in the feed pipe, the discharge pipe and the bypasses. These valves can be expediently actuated in such a manner that no pipe with overheated media can be closed on both sides. This is more specifically necessary in steam generating plants in order to avoid excessively high pressures in the pipes.

In order to simplify such a regulation, it is proposed that a three-way valve be disposed between the medium inlet, the first bypass and the feed pipe. A three-way valve makes sure that the medium from the medium inlet is distributed to the bypass and the feed pipe. The three-way valve can thereby be adjusted in such a manner that it always conveys the entire inflow at the medium inlet without the cross-section of the pipe system being reduced or even closed in this place.

It is advantageous to correspondingly also provide a three-way valve between the medium outlet, the second bypass and the discharge pipe. Closing the pipes should also be avoided here and the total volume flow should preferably remain nearly constant even while switching the valve.

An advantageous field of application of the device is the treatment of liquid media. This applies mainly to media with a temperature exceeding 130° C.

Different media can thereby be carried opposite to the medium in the heat exchanger. A broad field of application is disclosed with heat exchangers through which a gas flows.

An alternative implementation provides here that the gas flows from the heat exchanger entrance to the heat exchanger exit. However, depending on the setting of the plant, the gas can also flow from the heat exchanger exit to the heat exchanger entrance.

Since a broad field of application of the device relates to steam generators, it is proposed that the gas should have a temperature above 100° C.

The described device can be used in different places in a steam generating plant. Here, the heat exchanger can be a superheater, an economizer or a combustion air preheater.

Operating a device with a denitrogenization apparatus is particularly advantageous since the exhaust gas temperature in the denitrogenization apparatus can thereby be maintained in a specified temperature window in a simple manner over a long period of operation of the plant.

The object underlying the invention is also solved by a method for operating a heat exchanger of a steam generating plant, in which the heat exchanger can be adjusted to operate in concurrent or countercurrent flow by means of valves. More specifically heat exchangers of a steam generating plant can thereby be operated in such a manner that the required gases are maintained in specific temperature windows and it is possible to switch from concurrent to countercurrent flow operating mode during operation.

This method can be particularly easily realized if the switching occurs via two three-way valves. This simplifies valve control and makes it possible, because of the configuration of the valves and independently from control, to ensure that no overheated media are conducted in pipes of the steam generating plant which are completely closed at the pipe entrance and at the pipe exit.

BRIEF DESCRIPTION OF THE DRAWINGS

Exemplary embodiments of the device and of the method are shown in the figures and are further explained in the following. In the drawing.

DETAILED DESCRIPTION OF PREFERRED EMBODIMENTS

Figure 1:
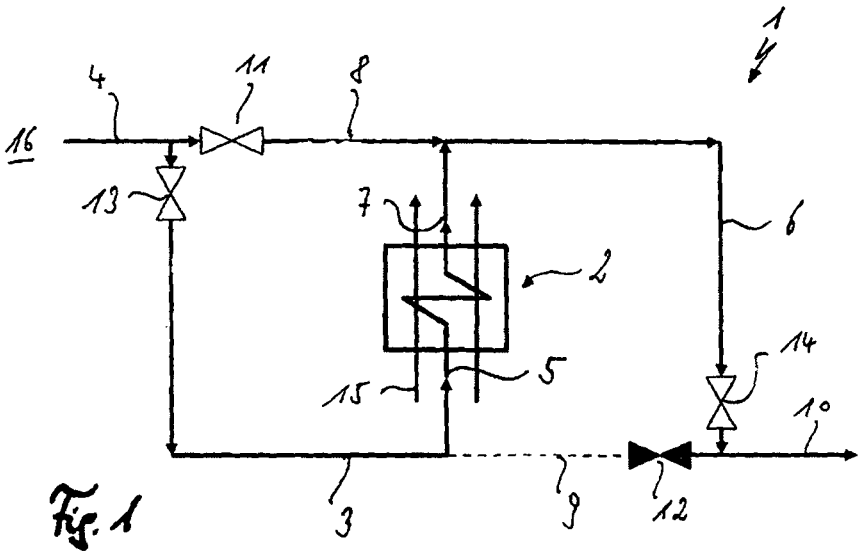
FIG. 1 shows a heat exchanger switching mechanism with four valves in concurrent flow operation mode.

The device 1 shown in FIG. 1 consists substantially of a heat exchanger 2, which is supplied with a medium 16 via a feed pipe 3. This feed pipe 3 leads from a medium inlet 4 to the heat exchanger entrance 5. A discharge pipe 6 from the heat exchanger exit 7 is provided on the side facing away from the heat exchanger entrance. A first bypass 8 thereby leads from the medium inlet 4 to the discharge pipe 6 and a second bypass 9 leads from the feed pipe 3 to the medium outlet 10.

A first bypass valve 11 is provided between the medium inlet and the first bypass 8 and a second bypass valve 12 is provided between the second bypass 9 and the medium outlet 10. A feed pipe valve 13 is disposed in the feed pipe 3 and a discharge pipe valve 14 is provided in the discharge pipe 6.

In the present case, the second medium is a gas, the flow of which is indicated by the arrows 15. In the example shown in FIG. 1, the heat exchanger 2 thus operates in concurrent flow.

To this end, the feed pipe valve 13 and the discharge pipe valve 14 are open, so that the medium 16 flows concurrently with the gas 15 through the heat exchanger 2. The first bypass 8 thereby makes it possible to adjust the heat exchanger output and the temperature of the medium at the medium outlet 10 via the first bypass valve 11. In this setting, the second bypass valve 12 is closed, so that no medium flows through the second bypass 9.

Figure 2:
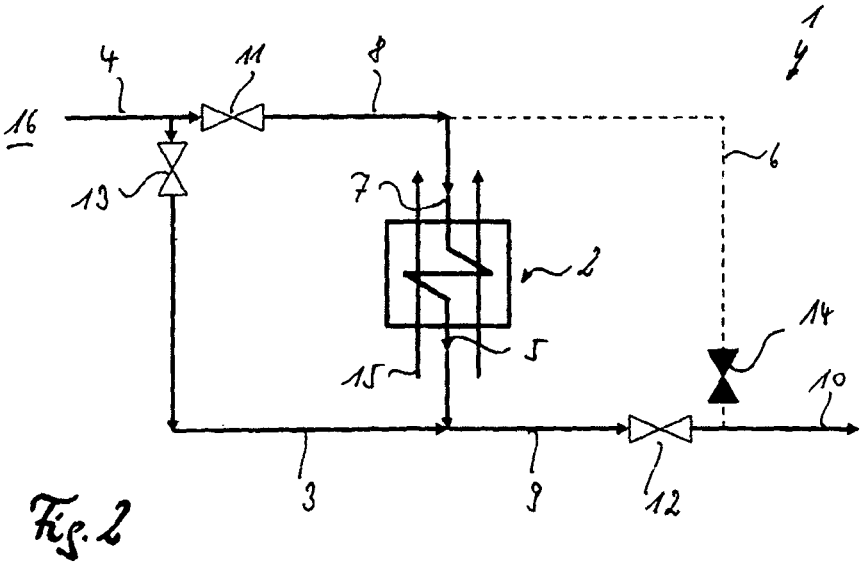
FIG. 2 shows a heat exchanger switching mechanism with four valves in countercurrent flow operation mode.

In the setting shown in FIG. 2, the medium 16 flows through the first bypass valve 11 and the first bypass 8, through the heat exchanger 2 to the second bypass valve 12 and from there to the medium outlet 10. Since the gas still flows in the direction of the arrows 15, the heat exchanger 2 is operated in countercurrent flow with this valve setting. Adjusting the medium temperature at the medium outlet 10 is possible by switching the feed pipe valve 13, thus achieving a bypass flow from the medium inlet 4 directly to the medium outlet 10. The route from the medium inlet via the discharge pipe 6 to the medium outlet 10 is closed by the discharge pipe valve 14.

Figure 3:
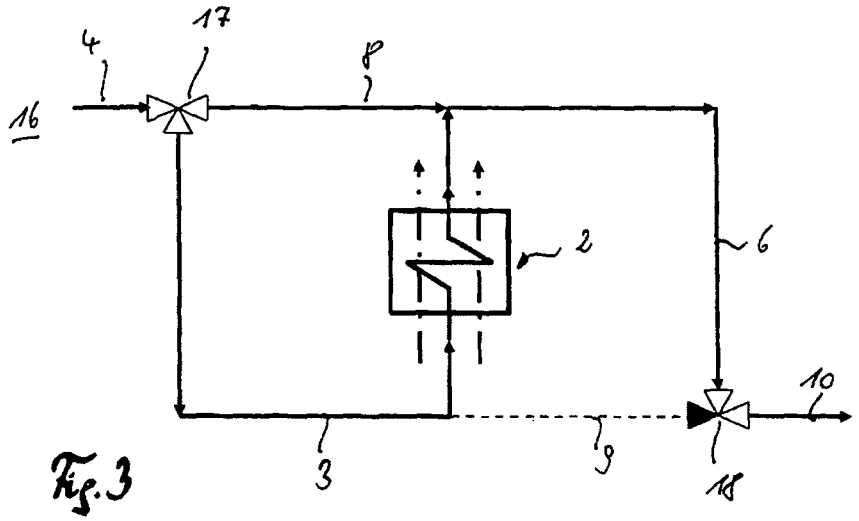
FIG. 3 shows a heat exchanger switching mechanism with two valves in concurrent flow operation mode.
Figure 4:
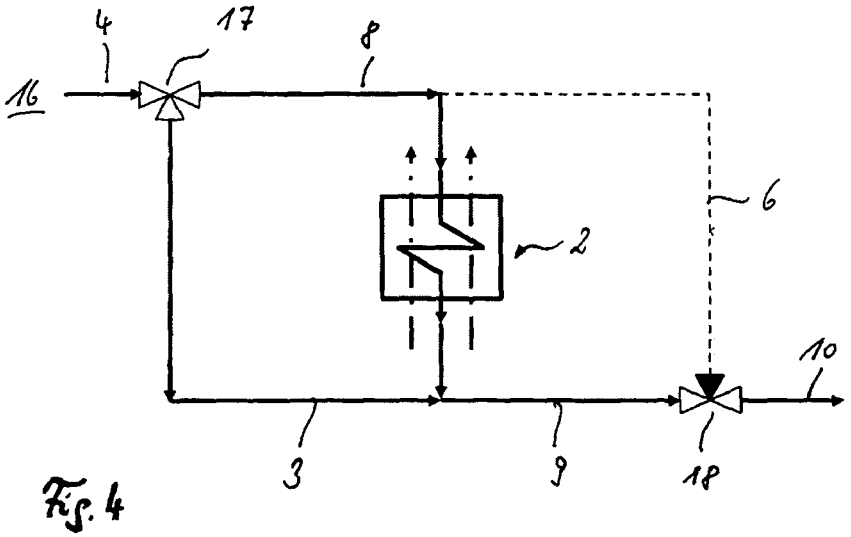
FIG. 4 shows a heat exchanger switching mechanism with two valves in countercurrent flow operation mode.

In FIGS. 3 and 4 however, the switching mechanisms shown in FIGS. 1 and 2 are correspondingly described with respectively 2 two-way valves. The bypass valve 11 and the feed pipe valve 13 have thereby been merged into a first three-way valve 17 while the bypass valve 12 and the discharge pipe valve 14 are merged into a second three-way valve 18. The first bypass valve 17 thus distributes the medium 16 coming from the medium inlet 4 to the feed pipe 3 and the first bypass 8. The second three-way valve 18 correspondingly conducts the medium carried in the discharge pipe 6 together with the medium coming from the second bypass 9 to the medium outlet 10.

The heat exchanger 2 can thus be switched from the concurrent flow operation mode shown in FIG. 3 to the countercurrent flow operation mode shown in FIG. 4. Whereas during the concurrent flow operation mode the second bypass 9 is closed by the setting of the second three-way valve 18, in the countercurrent operation mode the second three-way valve 18 closes the discharge pipe 6 while the second bypass 9 is open.

Figure 5:
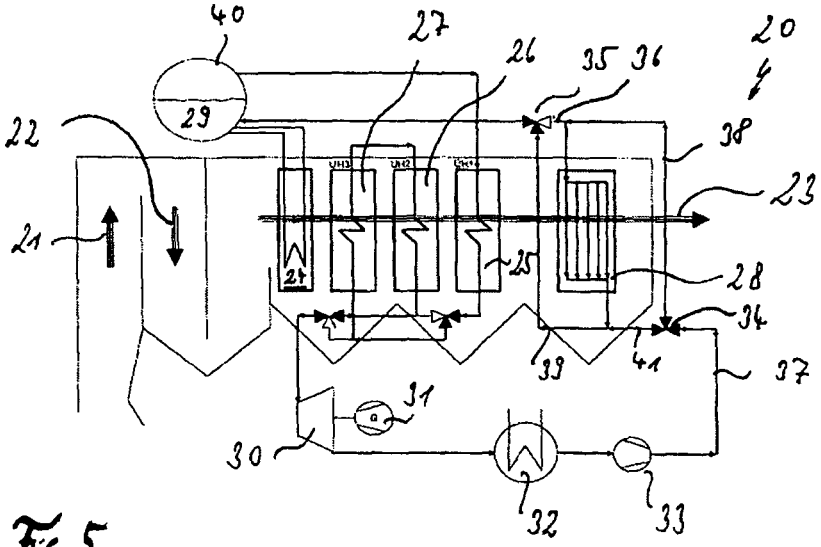
FIG. 5 shows a steam generating plant with an economizer in concurrent flow operation mode and FIG. 6 shows a steam generating plant with an economizer in countercurrent flow operation mode.

In the steam generating plant 20 shown in FIG. 5, the firing system, in which combustible material, more specifically such as waste, is burnt with preheated combustion air, is not shown. The exhaust gases generated during combustion are indicated by arrows 21, 22 and 23.

These exhaust gases first flow through the evaporator 24 and then through three superheaters 25, 26, 27. The exhaust gases eventually flow through an economizer 28 before being fed to a catalytic denitrogenization plant (SCR) not shown in the drawing.

The water 29 serving as a cooling medium is evaporated in the evaporator 24 and is fed as steam via the first superheater 25, then via the third superheater 27 and lastly via the second superheater 26 to a turbine 30 which drives a generator 31. It then flows through a condenser 32 and is conveyed to the economizer 28 via a pump 33. The first three-way valve 34 is thereby open in accordance with the setting shown in FIG. 3 and the second three-way valve 35 is switched in such a manner that the second bypass 36 is closed.

The medium thus flows from the medium inlet 37 via the first three-way valve 34 and the feed pipe 38 to the economizer 28 and from the economizer 28 via the discharge pipe 39 and the second two-way valve 35 to the boiler drum 40. Controlling the medium temperature is thereby possible via the first bypass 41 between the first bypass valve 34 and the discharge pipe 39.

Figure 6:
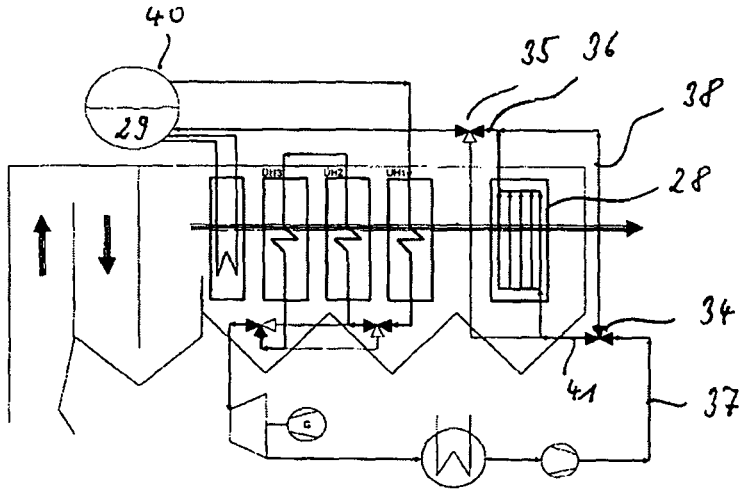

FIG. 6 shows that the economizer 28 can be switched from the concurrent flow operation mode shown in FIG. 5 to a countercurrent flow operation mode shown in FIG. 6 by a mere switching of the second bypass valve 35. In this setting, the water 29 flows from the medium inlet 37 via the first two-way valve 34 and the first bypass 41 to the economizer 28. From there, the water gets to the second three-way valve 35 via the second bypass 36 and back to the boiler drum 40.

In this setting, the feed pipe 38 assumes the function of a possible bypass, in order to conduct the water, under control by the first three-way valve 34, past the economizer 28 directly to the first three-way valve 35 and from there to the boiler drum 40. The water 29 serving as a cooling medium is evaporated in the evaporator 24 and is fed as steam first via the first superheater 25, then via the second superheater 26 and finally via the third superheater 27 to the turbine 30 which drives the generator 31. This makes it possible in this setting also to provide a regulation of the medium temperature on the gas and the water side in a simple manner without further expenses in pipes and valves. It is furthermore possible during operation to switch from concurrent flow operation mode to countercurrent flow operation mode and back.

What is claimed is:

1. A process for cooling firing system exhaust gas having a temperature above 100° C. in a heat exchanger of a steam generating plant, the process comprising the steps of:

providing a heat exchanger comprising a plurality of pipes;

initially flowing cooling water or steam having a temperature above 130° C. through the pipes of the heat exchanger in a concurrent flow operation mode;

lowering a temperature of the firing system exhaust gas flowing outside the pipes of the heat exchanger by switching a flow of the cooling water or steam flowing through the pipes of the heat exchanger from the concurrent flow operation mode to a countercurrent flow operation mode by adjusting a plurality of three-way valves when an efficiency of the heat exchanger drops due to deposits produced by the firing system exhaust gas on an outside of the pipes of the heat exchanger; and actuating the plurality of three-way valves such that no pipe of the plurality of pipes of the heat exchanger containing the cooling water or steam is closed on both sides.

2. The process for cooling firing system exhaust gas in a heat exchanger of a steam generating plant according to claim 1, wherein the heat exchanger comprises:

a heat exchanger entrance; a heat exchanger exit; a feed pipe for the cooling water leading from a medium inlet to the heat exchanger entrance; a discharge pipe leading away from the heat exchanger exit to a medium outlet; a first bypass leading from the medium inlet to the discharge pipe; and a second bypass leading from the feed pipe to the medium outlet; and wherein the plurality of three-way valves comprises:

a first three-way bypass valve coupling the medium inlet to the first bypass and to the feed pipe; and a second three-way bypass valve coupling the medium outlet to the second bypass and to the discharge pipe.

3. The process for cooling firing system exhaust gas in a heat exchanger of a steam generating plant according to claim 2, wherein the step of initially flowing the cooling water or steam through the heat exchanger in the concurrent flow operation mode comprises the steps of configuring the first three-way bypass valve to convey the cooling water or steam from the medium inlet to the feed pipe and configuring the second three-way bypass valve to convey the cooling water or steam from the discharge pipe to the medium outlet and to prevent the cooling water or steam from flowing from the second bypass to the medium outlet, thereby causing the cooling water or steam to flow from the heat exchanger entrance to the heat exchanger exit in a concurrent flow.

4. The process for cooling firing system exhaust gas in a heat exchanger of a steam generating plant according to claim 2, wherein the step of lowering a temperature of the firing system exhaust gas by switching the flow of the cooling water or steam through the heat exchanger from the concurrent flow operation mode to countercurrent flow operation mode comprises the steps of configuring the first three-way bypass valve to convey the cooling water or steam from the medium inlet to the first bypass and configuring the second three-way bypass valve to convey the cooling water or steam from the second bypass to the medium outlet and to prevent the cooling water or steam from flowing from the discharge pipe to the medium outlet, thereby causing the cooling water or steam to flow from the heat exchanger exit to the heat exchanger entrance in a countercurrent flow.

* * * * *